US006772962B2

(12) United States Patent
Sergodeyev

(10) Patent No.: US 6,772,962 B2
(45) Date of Patent: Aug. 10, 2004

(54) LOW FREQUENCY ACOUSTIC CONVERTER

(75) Inventor: Vladimir Vasilvevich Sergodeyev, Miloslavskove (RU)

(73) Assignee: Obschestvo s ogranichennoy otvetstvennostyu "Kvarts T-2000", Moscow (RU)

( * ) Notice: Subject to any disclaimer, the term of this patent is extended or adjusted under 35 U.S.C. 154(b) by 198 days.

(21) Appl. No.: 10/162,694

(22) Filed: Jun. 6, 2002

(65) Prior Publication Data

US 2003/0006184 A1 Jan. 9, 2003

(30) Foreign Application Priority Data

Jun. 9, 2001 (RU) ..... 2001/115666

(51) Int. Cl.[7] ..... B05B 1/08; B05B 17/04

(52) U.S. Cl. ..... 239/102.1; 239/102.2; 239/589.1; 239/4

(58) Field of Search ..... 239/102.1, 102.2, 239/338, 4, 101, 599, 589.1; 310/324, 331, 332, 321, 328

(56) References Cited

U.S. PATENT DOCUMENTS 3,719,168 A * 3/1973 Kazee ..... 118/306
4,585,167 A * 4/1986 Kholin ..... 239/4
5,261,601 A * 11/1993 Ross et al. ..... 239/102.2
5,586,550 A * 12/1996 Ivri et al. ..... 128/200.16
5,657,926 A * 8/1997 Toda ..... 239/102.2
6,135,357 A 10/2000 Herrin et al. ..... 239/4

FOREIGN PATENT DOCUMENTS

RU 484012 9/1975

* cited by examiner

*Primary Examiner*—Davis D Hwu
(74) *Attorney, Agent, or Firm*—Jacobson Holman PLLC

(57) ABSTRACT

The invention is related to mining industry, namely to devices for dispersion of solid minerals in particular quartz sands and associated minerals.

The gist of invention is that low frequency acoustic converter includes hollow case with feeding and discharge sections and piston exciter located in case with electromechanical reciprocating drive. It is equipped with acoustic energy concentrator whose semi-closed restricted inner volume has ellipsoid inner surface with two focal planes and is vented to case cavity at one side and to discharge section cavity at the other; the cavity of the case has two axisymmetrically located reflecting surfaces, and the upper one is of second order and has at least one charging opening vented to feeding section, while the bottom one passes smoothly into ellipsoid inner surface of semi-closed restricted volume of acoustic energy concentrator, one focal plane of the concentrator matching with focal plane of reflecting surface of second order, the other with discharge section inlet; the piston exciter is made of at least one piston connected to electromechanical drive by means of rod.

11 Claims, 5 Drawing Sheets

LOW FREQUENCY ACOUSTIC CONVERTER

The invention is related to mining industry, namely to devices for dispersion of solid minerals in particular quartz sands and associated minerals.

It's known an acoustic device for low frequency oscillation excitation in flotation pulp that contains hollow elastic shells forming the channel for flowing the liquid being processed, section for their alternate compression by pressing of compressed air onto their external surface by means of which pulp oscillations are excited (see SU 484012, B 03 D Jan. 14, 1975).

The drawback of the known device is low power of pulse action on flotation pulp and materials encompassed in it.

It's known low frequency acoustic converter including hollow case with feeding and discharge sections and piston exciter with electromechanical reciprocating drive placed in the case. (see U.S. 6,135,357, NKI 23914, 2000).

The drawback of the known device is low power of pulse action on the liquid being processed which leads to weak dispersion of inclusions in it. Lots of horizontal dynamic loads is also a drawback of the device with reciprocating piston movement.

The aim of the invention to patent is to increase pulse effect on liquid being processed and dispersion degree of its inclusions by means of multiple actions of impact loads from every pressure pulse and impact load concentration at certain areas within the device as well as decrease in horizontal dynamic loads during the work of reciprocating drive piston.

The solution of the mentioned problem is attained by fixing low frequency acoustic converter including hollow case with feeding and discharge sections, piston exciter with electromechanical reciprocating drive up with acoustic energy concentrator whose semi-closed restricted inner volume has ellipsoid inner surface with two focal planes and is vented to the case cavity at one side and to the discharge section at the other; the cavity of the case has two axisymmetrically located reflecting surfaces, and the upper one is of second order and has at least one charging opening vented to feeding section, while the bottom one passes smoothly into ellipsoid inner surface of semi-closed restricted volume of acoustic energy concentrator, one focal plane of the concentrator matching with focal plane of reflecting surface of second order, the other with discharge section inlet; the piston exciter is made of at least one piston connected to electromechanical drive by means of rod as well as by shaping the reflecting surface of second order as a part of spherical surface as well as by shaping the bottom surface of the case in the form of ellipsoid torus as well as by constructing piston exciter of three pistons located axisymmetrically in the cavity of the case and connected by rods to electromechanical reciprocating drive as well as by tight mutual coupling of lower parts of rods as well as by shaping pistons as ellipsoids as well as by lining outer surfaces of pistons as well as by lining inner surfaces of hollow case, concentrator of acoustic energy and discharge section as well as by forming the reciprocating drive as slider-crank mechanism connected by gimbal gear to drive in the form of at least one electric motor established on the base as well as by forming slider of slider-crank mechanism as a bushing installed with a slide fit onto stationary cylinder and bound by arm to the piston rods.

Vertical section of low frequency acoustic converter is shown on FIG. 1.

A—A line FIG. 1 section is shown on FIG. 2.

Electromechanical reciprocating drive located in the upper part of the converter is shown on FIG. 3.

Figure 1:
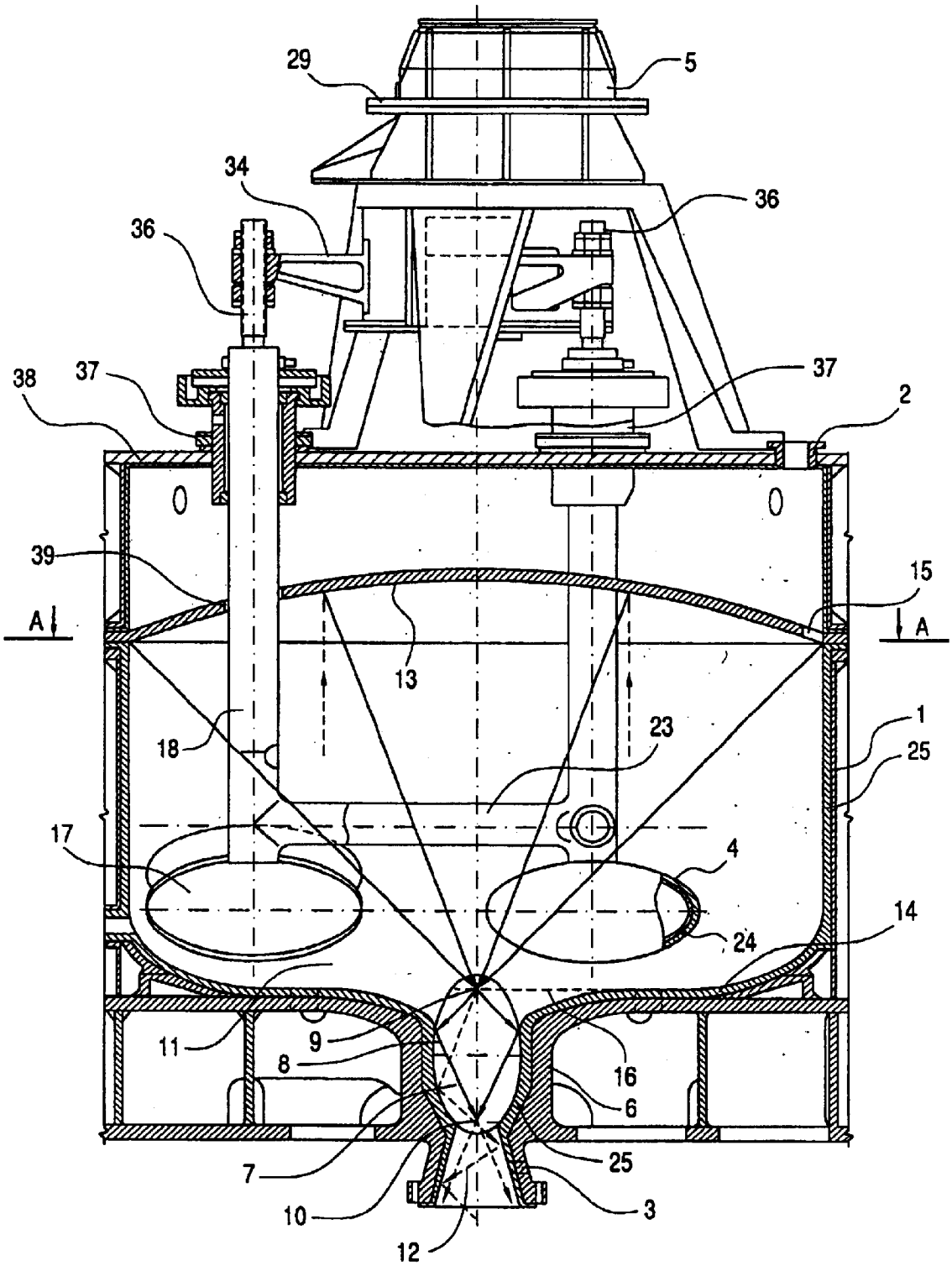
Figure 2:
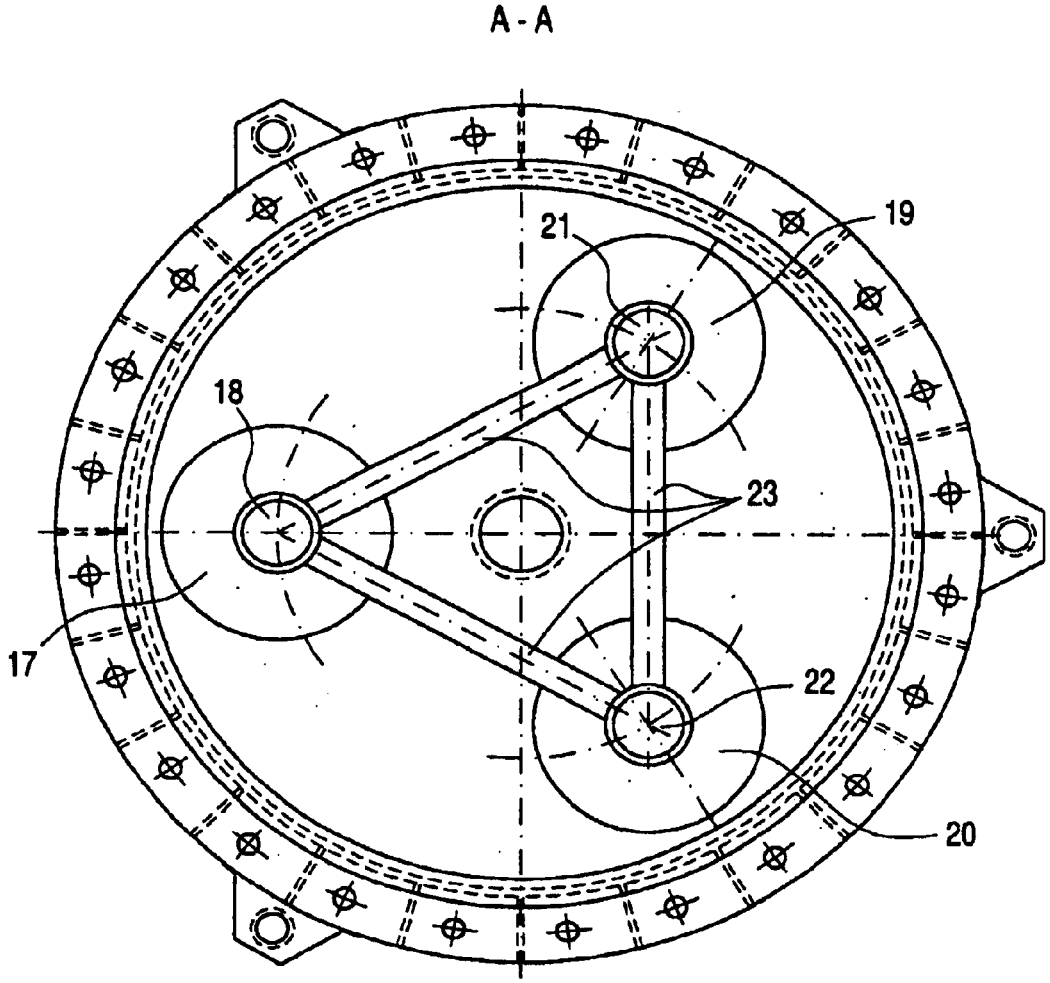
Figure 3:
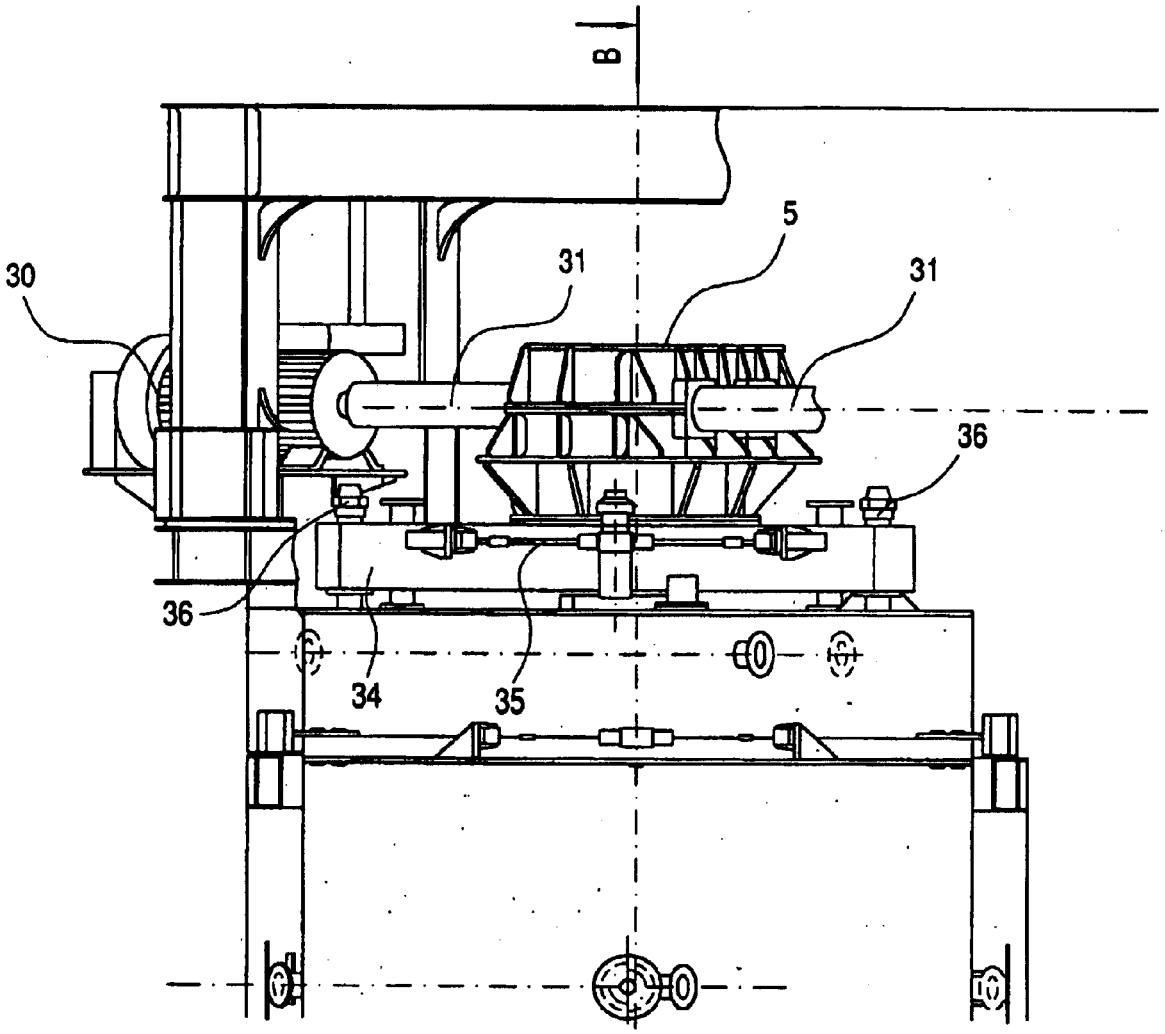
Figure 4:
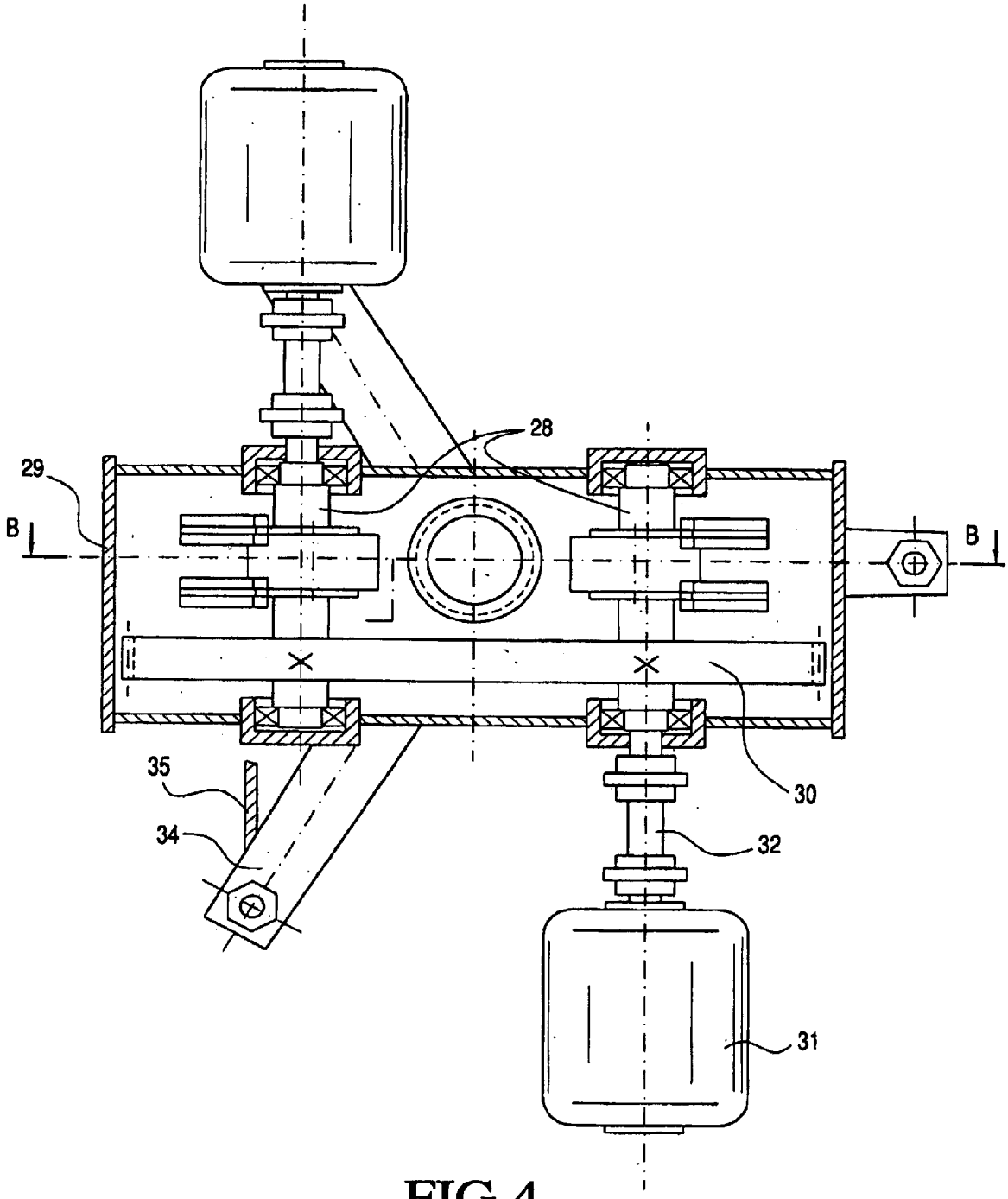
FIG. 4 is view B of FIG. 3.
Figure 5:
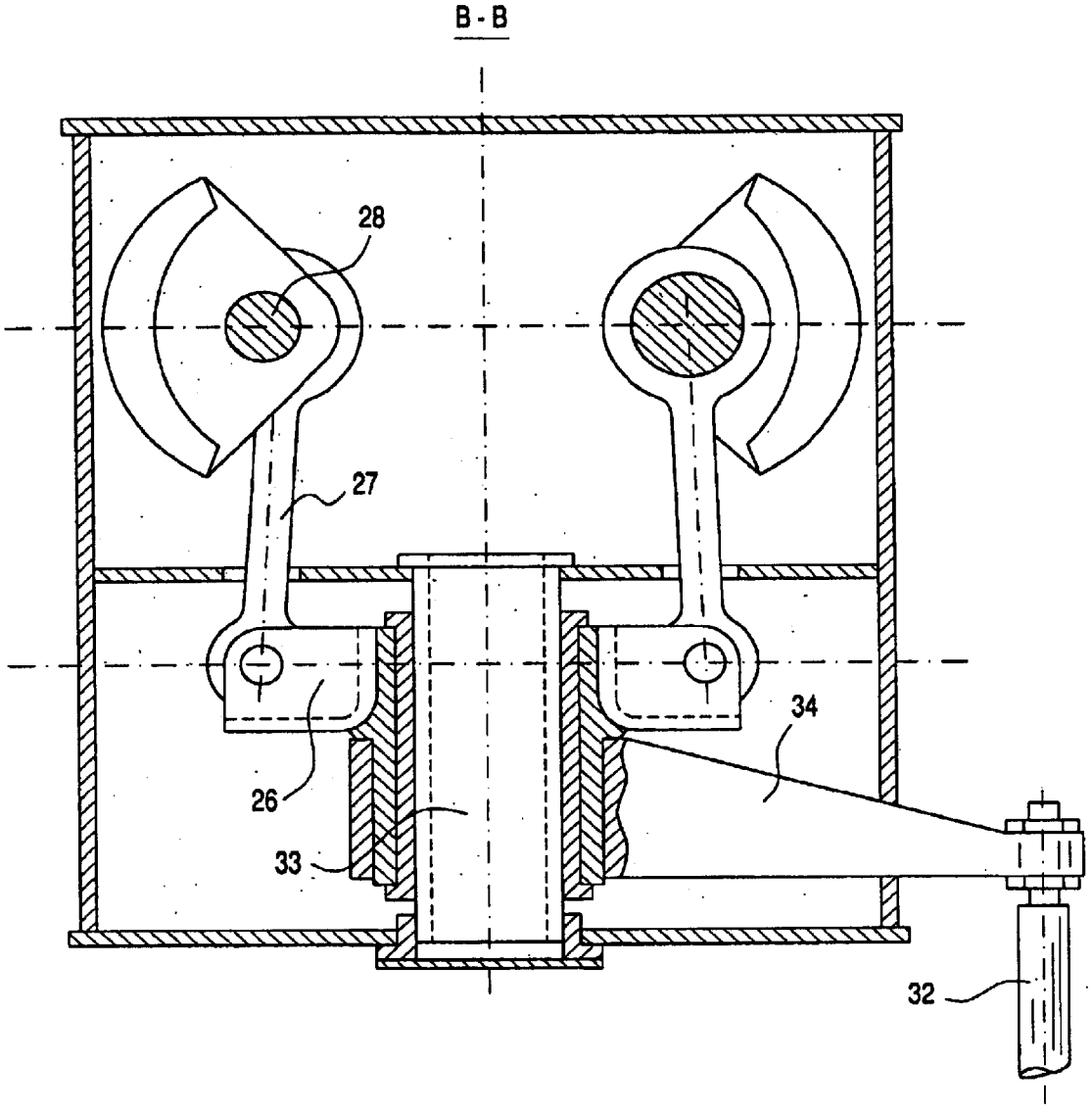
FIG. 5 shows slider-crank mechanism.

Low frequency acoustic converter consists of hollow case 1 with feeding 2 and discharge 3 sections. Within case 1 piston exciter 4 is installed and actuated by electromechanical reciprocating drive 5 located in the upper part of the converter above the case 1. In the lower part of case 1 acoustic energy concentrator 6 is installed. Semi-closed restricted inner volume 7 of acoustic energy concentrator 6 has an ellipsoid inner surface 8 with two focal planes 9 and 10. Inner volume 7 of acoustic energy concentrator 6 at one side (top) is vented to cavity 11 of case 1, while at the other (bottom) to cavity 12 of discharge section 3. Cavity 11 of case 1 is formed with axisymmetrically located reflecting upper surface 13 of second order and bottom surface 14. Upper surface 13 has at least one charging opening 15 in peripheral part, which is vented to feeding section 2. The bottom surface 14 of case 1 smoothly passes to ellipsoid inner surface 8 of the inner volume 7 of acoustic energy concentrator 6. The upper focal plane 9 of acoustic energy concentrator 6 is matched with focal plane 16 of reflecting surface 13 of second order. The bottom focal surface 10 of acoustic energy concentrator 6 is matched with discharge section inlet 3. Piston exciter 4 consists of at least one piston 17 connected by means of rod 18 to electromechanical drive 5. Piston exciter 4 may, for example, consist of three pistons 17,19 and 20, installed axisymmetrically in cavity 11 of case 1 and connected by rods 18, 21 and 22 to electromechanical reciprocating drive 5. Rods 18, 21 and 22 may mutually be tightly bound by links 23 to provide more rigidity.

Reflecting surface 13 of second order may be shaped in a form of spherical surface and the bottom surface in the form of ellipsoid torus. Pistons 17, 19 and 20 may be formed as ellipsoids and with lining 24 on the outer surface. Inner surfaces of hollow case 1, acoustic energy concentrator 6 and discharge section 3 are made with lining 25.

Electromechanical reciprocating drive 5 is preferably to be made in the form of slide-crank mechanism with slider 26 linked by connecting rods 27 with crankshafts 28 supported within the drive case 29 in bearings. Crankshafts 28 are bound to each other by means of gear wheels 30 and to electromechanical motors 31 by means of cardan shafts 32.

In order electric motors 31 not to sense vibrations due to converter work, they are installed on base (not shown). Slider 26 of slider-crank mechanism is installed with slide fit on stationary guide 33 fixed in drive case 29. Three-arm bracket with arms tied up with rods 35 for better rigidity is fixed to slider 26. On every arm of bracket 34 upper ends 36 of rods 18, 21 and 22 are fixed. Rods 18, 21 and 22 pass through hydraulic sealing 37 in upper lid 38 of case 1 and through holes 39 in upper surface of cavity 11 of case 1.

Low frequency acoustic converter works in the following way:

Damp material, for example sand-and-water pulp, from bin (not shown) through the feeding section 2 and charging opening 15 passes to cavity 11 of case 1. After turning electric motors 30 on their rotation is transmitted through cardan shafts 32 to crankshafts 28 of reciprocal mechanism 5 setting in motion connecting rods 27 and slider 26 bound to them. As a result slider 26 will make reciprocating motion sliding along stationary guide 33. Along with slider 26 reciprocating motion will be committed by tightly bound to it bracket 34 and consequently tightly bound to the latter rods 18, 21 and 22 and pistons 17,19 and 20. Two-phase mixture (sand-and-water pulp) begins oscillating and pistons 17,19 and 20 generate low frequency acoustic waves in pulp within the case 1, that reflect from spherical surface 13 and focuse on focal plane 9 of acoustic energy concentrator 6 having inner surface in the form of ellipsoid of revolution.

The sand-and-water pulp flow within acoustic energy concentrator 6 is subject to pulse action of acoustic energy as a result of its reverberations from inner surface, that makes the action more intensive with better use of energy flow. The processed material is discharged through discharge section 3.

In case of necessity discharge 3 may be closed with gate valve not shown on the drawing.

Mounting electric motors 31 on the base and the use of cardan shafts 32 to transmit rotation from electric motors 31 to crankshafts 28 of reciprocating mechanism 5 prevent transmission of vibration due to work of acoustic converter.

The presence of two crank mechanisms with contrarotating crankshafts allow horizontal dynamic loads be cut considerably.

The converter being patented let the pulse effect on pulp be increased and output material with greater degree of dispersion be obtained.

What is claimed is:

1. Low frequency acoustic converter including hollow case with feeding and discharge sections, piston exciter located in case with electromechanical reciprocating drive characterised in that it fixes up with acoustic energy concentrator whose semi-closed restricted inner volume has ellipsoid inner surface with two focal planes and is vented to case cavity at one side and to discharge section cavity at the other; the cavity of the case has two axisymmetrically located reflecting surfaces, and the upper one is of second order and has at least one charging opening vented to feeding section, while the bottom one passes smoothly into ellipsoid inner surface of semi-closed restricted volume of acoustic energy concentrator, one focal plane of the concentrator matching with focal plane of reflecting surface of second order, the other with discharge section inlet; the piston exciter is made of at least one piston connected to electromechanical drive by means of rod.

2. Low frequency acoustic converter of claim 1 characterised in that it shapes the reflecting surface of second order as a part of spherical surface.

3. Low frequency acoustic converter of claim 1 characterised in that it shapes the bottom surface of the case in the form of ellipsoid torus.

4. Low frequency acoustic converter of claim 1 characterised in that piston exciter is constructed of three pistons located axisymmetrically in the cavity of the case and connected by rods to electromechanical reciprocating drive.

5. Low frequency acoustic converter of claim 1 characterised in that there is tight mutual coupling of lower parts of rods.

6. Low frequency acoustic converter of claim 1 characterised in that pistons are shaped as ellipsoids.

7. Low frequency acoustic converter of claim 1 characterised by lining outer surfaces of pistons.

8. Low frequency acoustic converter of claim 1 characterised by lining inner surfaces of hollow case, concentrator of acoustic energy and discharge section.

9. Low frequency acoustic converter of claim 1 characterised by forming the reciprocating drive as slider-crank mechanism connected by gimbal gear to drive in the form of at least one electric motor established on the base.

10. Low frequency acoustic converter of claim 9 characterised by forming slider of slider-crank mechanism as a bushing installed with a slide fit onto a stationary guide and connected by bracket with at least one rod of piston or with rods of pistons.

11. Low frequency acoustic converter of claim 10 characterized by fitting it up with second crank mechanism whose crankshaft is connected to rotation drive from second electric motor installed on base, crankshafts of both crank mechanisms being mutually bound by means of gear wheels.

* * * * *